United States Patent [19]

Yamasaki

[11] Patent Number: 4,868,358

[45] Date of Patent: Sep. 19, 1989

[54] IMPLEMENT FOR PREVENTING LEAKAGE OF WAVES FROM MICROWAVE OVEN

[75] Inventor: Hiroka Yamasaki, Kobe, Japan

[73] Assignee: Kanegafuchi Kagaku Kogyo Kabushiki Kaisha, Osaka, Japan

[21] Appl. No.: 274,249

[22] Filed: Nov. 21, 1988

[30] Foreign Application Priority Data

Nov. 24, 1987 [JP] Japan ..... 62-179360[U]

[51] Int. Cl.[4] ..... H05B 6/76

[52] U.S. Cl. ..... 219/10.55 D; 219/10.55 R; 174/35 MS; 174/35 GC; 252/62.51

[58] Field of Search ..... 219/10.55 D, 10.55 E, 219/10.55 F, 10.55 R; 174/35 MS, 35 GC, 35 R; 428/68, 76, 161, 164; 252/62.51, 62.54, 62.55

[56] References Cited

U.S. PATENT DOCUMENTS

| | | | |
|---|---|---|---|
| 2,858,451 | 10/1958 | Silversher | 174/35 MS |
| 2,877,286 | 3/1959 | Vance et al. | 174/35 MS |
| 3,437,735 | 4/1969 | Schaller, Jr. | 174/35 MS |
| 4,046,983 | 9/1977 | Ishino et al. | 219/10.55 D |
| 4,051,341 | 9/1977 | Tanaka et al. | 219/10.55 D |
| 4,081,647 | 3/1978 | Torrey | 219/10.55 D |
| 4,602,141 | 7/1986 | Naito et al. | 219/10.55 D |
| 4,785,148 | 11/1988 | Mayer | 219/10.55 D |

*Primary Examiner*—Philip H. Leung

*Attorney, Agent, or Firm*—Armstrong, Nikaido, Marmelstein, Kubovcik & Murray

[57] ABSTRACT

There is disclosed an implement for preventing microwaves from leaking from the housing of a microwave oven. The implement is made from a synthetic resin and mounted inside the oven. One example of the implement consists of polymethylpentene molded into a desired shape. Carbon and a softener are dispersed in the polymethylpentene. Further, the polymethylpentene contains a ferrite and/or a powdered metal. Thus, the implement can withstand high-temperature air, whether it is dry or moist. Another example of the implement is intended to eliminate any gap between the housing and the inner surface of the door. This implement is fabricated by forming a synthetic resin layer containing a soft ferrite and a synthetic resin layer containing a hard ferrite in such a way that these two layers are stacked on top of each other, magnetizing the hard ferrite, and forming grooved portions used for separation in the laminated sheet by press work or embossing to obtain plural unit structural portions interconnected by the grooved portions.

10 Claims, 4 Drawing Sheets

IMPLEMENT FOR PREVENTING LEAKAGE OF WAVES FROM MICROWAVE OVEN

BACKGROUND OF THE INVENTION

1. Field of the Invention

The present invention relates to an improved implement which prevents leakage of microwaves from the housing of a microwave oven by absorbing or reflecting microwaves propagating outward from the housing.

2. Description of the Prior Art

A known means for preventing leakage of microwaves from a microwave oven consists of installing an annular sheet of a synthetic resin on the fringe of the opening of the housing or on the inner surface of the door bearing against the fringe or by installing two such annular sheets on the fringe of the opening and the inner surface of the door. The annular sheets are molded into a form similar to the fringe of the opening. A soft ferrite such as Mn-Zn ferrite or Ni-Zn ferrite is added to the sheets. The annular sheet or sheets are called implements for preventing leakage of microwaves from a microwave oven. The inherent function of a microwave oven is to heat food by microwaves. In recent years, however, an additional device such as an infrared ray-emitting device or steam generator has tended to be installed. Sometimes, even an external heating means such as a gas combustion heat source is added to raise the temperature inside the oven. In this microwave oven, the implement for preventing leakage of microwaves is required to have greater resistance to heat. In addition, moisture resistance and flexibility are needed. Where the conventional implement for preventing leakage of microwaves is made from a synthetic resin such as a nylon, the implement can withstand up to about 180° C. Where the implement is made from a rubber, it can be used up to approximately 150° C. Where the implement is made from polypropylene, it can withstand up to roughly 130° C. When infrared rays or steam is also generated inside a microwave oven, the temperature inside the oven increases to approximately 220°-240° C. The conventional leakage-preventing implement cannot withstand these high temperatures. Accordingly, the use of polyphenylene sulfide which can withstand such high temperatures may be contemplated. Unfortunately, this synthetic resin is brittle and expensive. Especially, a microwave oven having the aforementioned additional function is required to withstand a high temperature of about 230° C. for a short time of about 30 to 60 minutes. Since a leakage-preventing implement of this kind is interposed between the body of a microwave oven and its door, the implement preferably acts to absorb the mechanical shock produced when the door is closed or opened. Additionally, it is necessary that the leakage-preventing implement have flexibility so that it may be easily mounted inside the oven. After the implement has been mounted in the oven, it is desired that no gap be left between the fringe of the opening of the body of the oven and the inner surface of the door. Such a gap is created when hinges used to mount the door to the body chatter or when a foreign matter is introduced. If the gap is formed, microwaves leak through the gap. Therefore, leakage of microwaves cannot be prevented however effectively the leakage-preventing implement absorbs microwaves. As an example, if the gap is in excess of 2 mm, then the capability of the implement to absorb microwaves drops greatly.

SUMMARY OF THE INVENTION

It is an object of the present invention to provide an implement which prevents leakage of microwaves from a microwave oven and can be used under an atmosphere of moist high-temperature air.

It is another object of the invention to provide an implement which prevents leakage of microwaves from a microwave oven, is capable of reducing the gap formed between the fringe of the opening of the body of the oven and the inner surface of the door, is easy to fabricate, and can be manufactured with high dimensional accuracy.

It is a further object of the invention to provide an implement which prevents leakage of microwaves from a microwave oven and has improved short-time heat resistance, flexibility, and moisture resistance.

The first-mentioned object is achieved by a microwave leakage-preventing implement made from polymethylpentene in which a softener and materials for absorbing or reflecting microwaves are dispersed. The materials are comprised of carbon along with a ferrite and/or a powdered metal. Polymethylpentene can withstand moist high-temperature air, i.e., shows resistance to heat and moisture, as well as dry high-temperature air. Therefore, the implement can be used in an up-to-date microwave oven capable of generating either infrared rays or steam.

The second-mentioned object is achieved by a microwave leakage-preventing implement comprising a laminated sheet which consists of two synthetic resin layers stacked on top of each other. One of the layers contains a soft ferrite, while the other contains a hard ferrite. The hard ferrite is magnetized. Grooved portions used for separation are formed in the laminated sheet by press work or by using embossing rolls. A plurality of unit structural portions interconnected by the grooved portions are formed.

In this leakage-preventing implement, the grooved portions are formed between the successive unit structural portions each of which takes the form of a long plate. All of the grooved portions or some of the grooved portions located at regular intervals are cut by hand or with a knife or other means to obtain either separate unit structural regions or blocks each consisting of several interconnected unit structural regions. These implements are each mounted between the body of a microwave oven and its door. The magnetic force of the synthetic resin containing the hard ferrite attracts the door to the body of the oven, thus eliminating any gap between the body and the door. The synthetic resin layer containing the soft ferrite attenuates leaking electromagnetic waves.

DETAILED DESCRIPTION OF THE PREFERRED EMBODIMENTS

Before describing specific examples of the invention, we now define the words "hard ferrite" and "soft ferrite". A strong magnetic field is necessary to reverse the sense of the magnetization of a hard ferrite. However, once a hard ferrite is magnetized, the magnetization remains almost permanently. A soft ferrite is magnetized by the application of a quite weak magnetic field. When a magnetic field applied from one direction is changed only quite slightly, the sense of the magnetization can be reversed.

Figure 1:
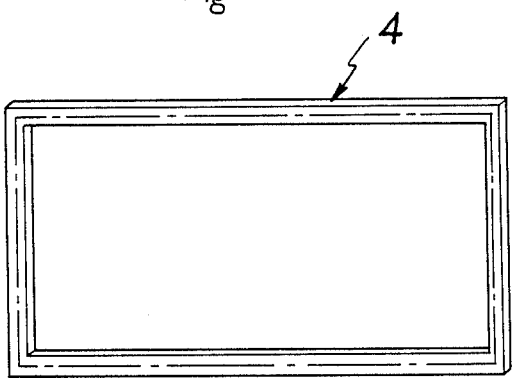
FIG. 1 is a front elevation of a microwave leakage-preventing implement according to the invention.
Figure 2:
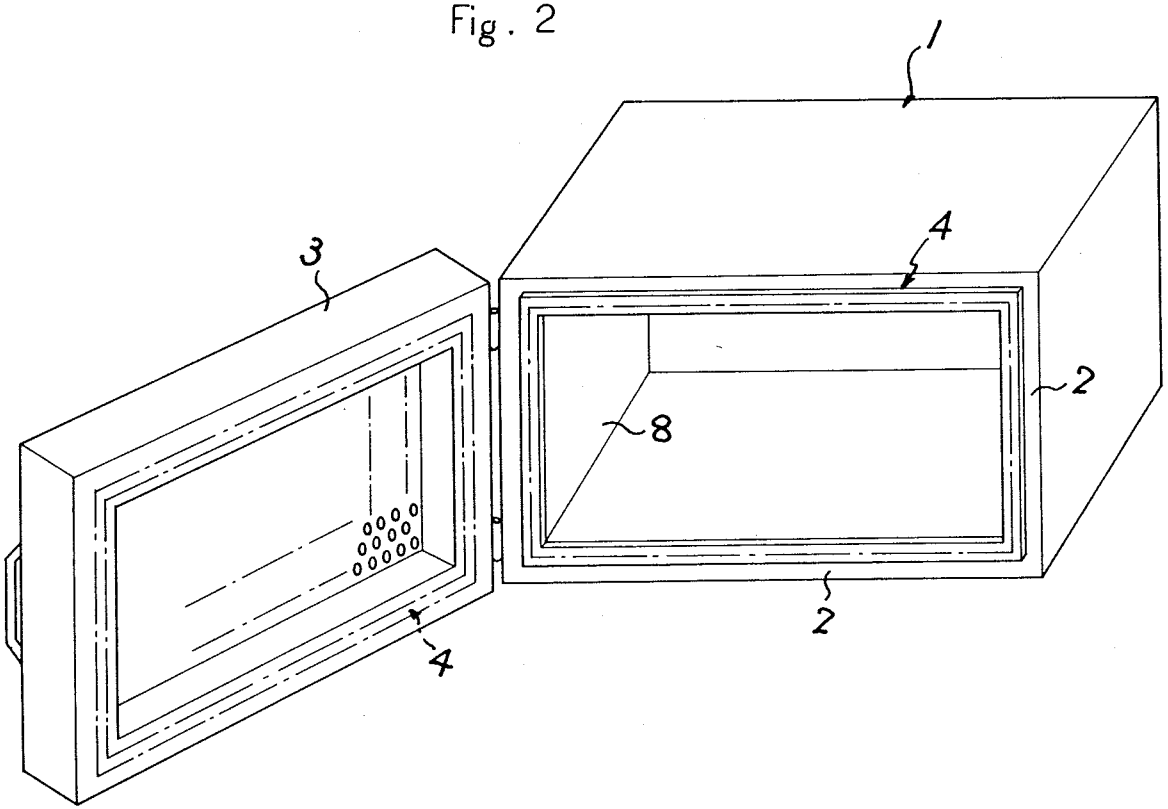
FIG. 2 is a perspective view of a microwave oven, and in which the implement shown in FIG. 1 is mounted on the fringe of the opening of the oven.

Referring to FIGS. 1 and 2, a microwave leakage-preventing implement according to the invention is a molded annular sheet 4 which is similar in shape to the fringe 2 of the opening of the body of a microwave oven. The implement is mounted either on the fringe 2 of the opening or on the inner surface of the door 3 bearing against the fringe 2 to close or open the opening or mounted on both.

Figure 3:
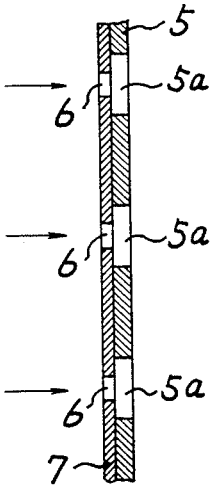
FIG. 3 is a fragmentary cross-sectional view of a modification of the implement shown in FIGS. 1 and 2, and in which the implement taking the form of a plate provided with a number of vent holes is mounted on the surface of a metal plate on the side wall of a microwave oven.

Referring to FIG. 3, there is shown a modification of the microwave leakage-preventing implement shown in FIGS. 1 and 2. The modified implement consists of a plate 7 provided with a number of vent holes 6. The plate 7 can be mounted on the inner surface of a porous metal plate 5 that forms the inner side wall 8 of the body of a microwave oven.

These novel implements for preventing leakage of microwaves act to absorb or reflect microwaves. The implements are excellent in resistance to heat and resistance to moisture. Therefore, these implements can be used in an up-to-date microwave oven equipped with an external heating means generating infrared rays or high-temperature steam or utilizing combustion of gas, as well as in a conventional microwave oven which only emits microwaves toward food. The inside of the oven is raised to a high temperature or permeated with moist high-temperature air by the external heating means. The novel leakage-preventing implement is employed on various portions of the inside of this oven to absorb or reflect microwaves which would otherwise leak from the oven. The implement is fabricated by adding either a ferrite or a powdered metal or both to polymethylpentene together with carbon and a softener, dispersing these added components in the polymethylpentene, and molding the mixture into a desired shape according to the location where the implement is used. The ferrite can be soft ferrite, such as Mn-Zn ferrite, Ni-Zn ferrite, Mn-Mg ferrite, magnetite, a mixture of a soft ferrite and carbon, a mixture of a soft ferrite and carbonyl iron dust, or a combination thereof. Since these ferrites serve to absorb leaking microwaves, if they are introduced into polymethylepentene as mentioned above, then leaking microwaves are absorbed or attenuated. When a powdered metal is used instead of a ferrite, leaking microwaves are not absorbed but reflected. As an example, when the implement is placed between the fringe of the opening of the body of a microwave oven and the inner surface of the door, the implement reflects microwaves which would otherwise pass through the gap between the body of the oven and the inner surface of the door. The reflected waves return to the body. The powdered metal can be fine particles of a pure metal, such as aluminum, copper, iron, or brass, or an oxide of a pure metal, such as magnetite, or α-iron oxide. Also, a ferrite and a powdered metal mixed in an appropriate ration can be used. An annular microwave leakage-preventing implement can be divided into an outer portion and an inner portion. A layer of a synthetic resin containing a soft ferrite is formed on the outer portion. A hard ferrite, such as Ba ferrite or Sr ferrite is added to a rubber or a plastic. The mixture or a hard ferrite alone is sintered, magnetized, and disposed on the inner portion.

The up-to-date microwave oven must withstand high temperatures of about 220°-240° C. for about 30 to 60 minutes. Since the melting point of polymethylpentene is approximately 240° C., it can be seen that the short-time heat resistance of the novel microwave leakage-preventing implement comprising polymethylpentene is sufficiently high to be used inside an up-to-date microwave oven equipped with an external heating means. Polymethylpentene is highly resistant to high temperatures as described above. Further, it is excellent in resistance to moisture. When it is exposed to high-temperature steam, it does not swell. Resistance to moisture is quite important for microwave leakage-preventing implements. We now discuss this property further.

As an example, a microwave leakage-preventing implement is made from a nylon, taking only heat resistance into account. This nylon implement can withstand comparatively high temperatures, for example about 180° C. However, it is known that when the humidity of the air is normal, nylon 6 contains about 2% of moisture and swells even at normal temperature. Accordingly, where a microwave leakage-preventing implement is made from nylon 6 or other similar material and mounted on a portion requiring a certain clearance, if high-temperature air does not contain moisture, then no problems will take place. However, if the air contains moisture, then the preventive implement swells, closing up the clearance. If only resistance to moisture at high temperatures is considered, the use of polyphenylene sulfide may be contemplated. However, it cannot be used easily, because it is expensive. On the other hand, polymethylpentene used in the present invention is excellent in resistance to both heat and moisture. In addition, it is inexpensive and quite excellent in moldability. Hence, a microwave leakage-preventing implement is made most preferably from polymethylpentene.

Since polymethylpentene is flexible, a molded preventive implement can be easily fitted into a corresponding portion. Further, after the implement is mounted, mechanical shock produced by closing or opening the door is reduced. In addition, the flexibility prevents the implement from being deformed by internal stress produced by thermal shrinkage and allows the implement to regain its original shape if the implement is deformed. The softener is used to maintain the consistency of polymethylpentene after carbon is added to polymethylpentene together with a ferrite and/or a powdered metal. Generally, the softener is silane coupler.

Carbon is added to polymethylpentene together with a ferrite and/or a powdered metal in the ratios described below. It is desired that 20–85% by weight of a ferrite be added to 15–80% by weight of polymethylpentene. It is required that 0.05–0.20 part by weight of softener be added to 1 part by weight of polymethylpentene. Where the proportion of the added ferrite is less than 20% by weight, i.e., the proportion of polymethylpentene is in excess of 80% by weight, the ability of the implement to absorb microwaves is low and so the market value of the implement is low. Hence, this range of proportions is excluded. Where the ratio of the added ferrite is in excess of 85% by weight, i.e., the ratio of polymethylpentene is less than 15% by weight, the moldability is poor and, therefore, a leakage-preventing implement having a desired rigidity cannot be obtained. Consequently, this range of ratios is also excluded.

As described thus far, the novel implement for preventing leakage of microwaves from a microwave oven includes polymethylpentene as its base material. Carbon is added to the base material. Further, either a ferrite or a powdered metal or both are added to the material. The preventive implement consisting of these components functions to absorb or reflect microwaves. Also, the implement shows resistance to heat and moisture for a short time when it is exposed to dry or moist high-temperature air. Furthermore, the implement is flexible. Therefore, the microwave leakage-preventing implement is preferably used in up-to-date microwaves ovens frequently equipped with an external heating means.

The microwave leakage-preventing implement shown in FIG. 1 takes the form of an annular sheet 4 as described already. The microwave leakage-preventing implement shown in FIG. 3 assumes the form of a molded plate 7 provided with a multiplicity of vent holes 6. The plate 7 is mounted on the surface of the porous metal plate 5 which forms the inner side wall 8. In this case, the plate 7 absorbs leaking microwaves. Some of steam or high-temperature gas inside the body 1 of the oven is discharged through the vent holes 6 in the plate 7 and also through holes 5*a* punched in the porous metal plate 5.

Figure 4:
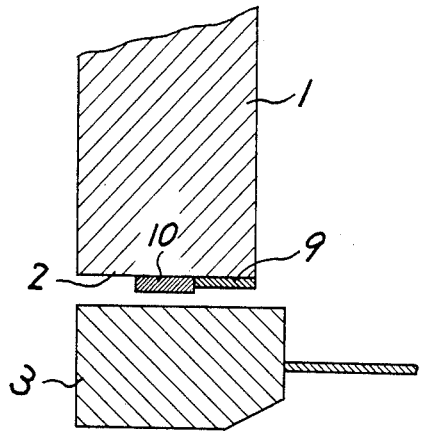
FIGS. 4 and 5 are cross-sectional views of main portions of further modifications of the implements shown in FIGS. 1 and 2.
Figure 5:
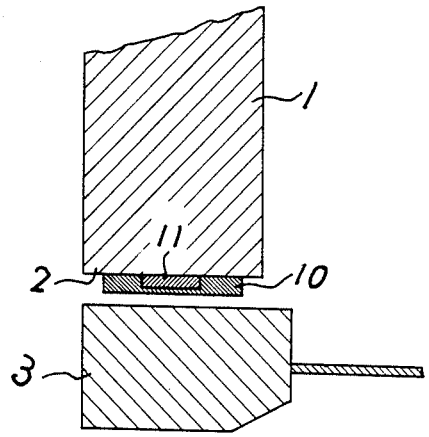

FIGS. 4 and 5 show modifications of the annular sheet 4 shown in FIG. 1. In FIG. 4, an annular sheet 4 has an inner portion and an outer portion. A hard ferrite is dispersed in one of these two portions, while a soft ferrite is dispersed in the other. The sheet 4 was placed in a magnetic field to magnetize the hard ferrite. A synthetic resin layer 9 contains the magnetized hard ferrite and magnetizes the inner surface of the cover 3. A synthetic resin layer 10 contains the soft ferrite and absorbs leaking microwaves. In the illustrated example, the synthetic resin layer 9 containing the magnetized hard ferrite is formed on the inner portion. The synthetic resin layer 10 containing the soft ferrite is formed on the outer portion. The layer 9 containing the hard ferrite is thinner than the layer 10 containing the soft ferrite. The layer 9 containing the hard ferrite attracts the door 3 to cause the thicker layer 10 containing the soft ferrite to bear against the inner surface of the door 3, thereby providing seal. In this state, leaking microwaves are absorbed.

Referring to FIG. 5, a permanent magnet 11 is buried in polymethylpentene in which carbon and a softener are dispersed. Also, either a ferrite or a powdered metal or both are dispersed in the polymethylpentene. The permanent magnet 11 attracts the door 3 to the fringe 2 of the opening of the body. The synthetic resin layer 10 containing the soft ferrite is brought into contact with the door 3. Under this condition, leaking microwaves are absorbed. As described thus far, the novel implements for preventing leakage from microwave ovens can be used on various portions of up-to-date microwave ovens in which high-temperature air that may or may not contain moisture is produced. The implements absorb or reflect leaking microwaves and have good heat resistance, moisture resistance, and flexibility.

Figure 6:
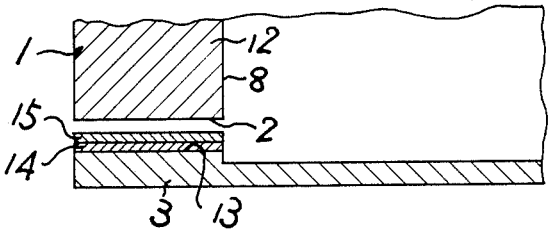
FIG. 6 is a cross-sectional view of main portions of a microwave oven in which another microwave leakage-preventing implement according to the invention is mounted.

Referring next to FIG. 6, there is shown another microwave leakage-preventing implement according to the invention. The body 1 of a microwave oven has a side wall 12. The oven further includes a door 3 having a peripheral frame 13 which bears against the side wall 12. A synthetic resin layer 14 containing a hard ferrite is formed on the inner surface of the door 3. A synthetic resin 15 containing a soft ferrite is formed on the layer 14. The hard layer 14 containing the magnetized hard ferrite is used as a plastic magnet. The inner surface of the door 3 is attracted to the fringe 2 of the opening of the body 1 by the magnetic force of the synthetic resin layer 14 containing the hard ferrite. As the oven ages, a gap may be created between the fringe 2 of the opening and the inner surface of the door 3. In this case, the magnetic force of the resinous layer 14 containing the hard ferrite attracts the inner surface of the door 3 to the fringe 2, thus taking up the gap which would otherwise cause leakage. Since the resinous layer 15 containing the soft ferrite is stacked on the resinous layer 14 containing the hard ferrite, if microwaves should leak, they would be attenuated while traveling through the resinous layer 15 containing the soft ferrite. In the illustrated example, the synthetic resin layer containing the soft ferrite is formed on the outside of the synthetic resin layer containing the hard ferrite. The positional relation between these two layers can be reversed.

Figure 7:
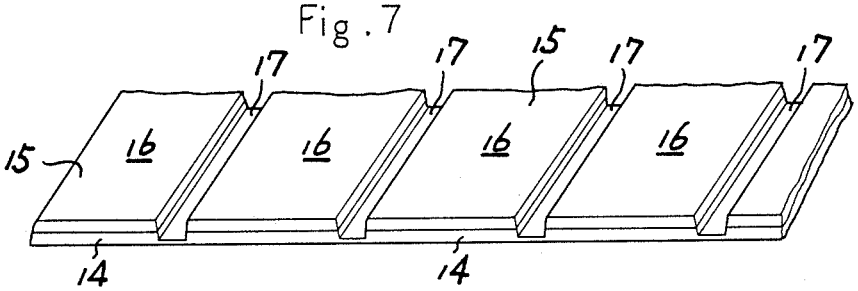
FIG. 7 is a perspective view of the implement shown in FIG. 6.
Figure 8:
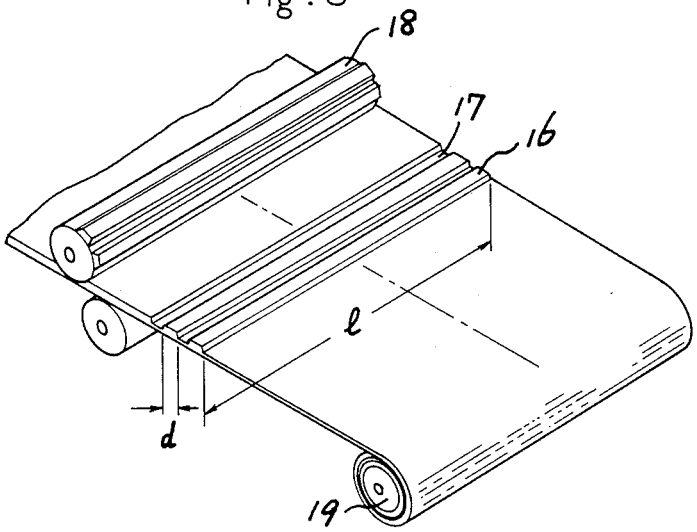
FIG. 8 is a view for illustrating the manner in which the implement shown in FIGS. 6 and 7 is fabricated.

A specific method of fabricating the microwave leakage-preventing implement is now described by referring to FIG. 7. A laminate sheet comprising the synthetic resin layer 15 containing the soft ferrite and the synthetic resin layer 14 containing the hard ferrite is fabricated. The layer 15 is formed on the outside of the layer 14. Unit structural portions 16 of a structure adapted for the application are formed out of the laminate sheet. In the illustrated example, each unit structural portion 16 takes the form of a simple long plate. Grooved portions 17 having a thickness of about 0.2–0.5 mm are formed at regular intervals to facilitate separation. The unit structural portions 16 are separated from each other at the positions of the grooved portions 17. The microwave leakage-preventing implement of this structure is formed by press working or by the use of embossing rolls 18 shown in FIG. 8. This method of fabricating the implement is much superior to the conventional extrusion molding. When microwave leakage-preventing implements are manufactured by extrusion molding, ferrite particles contained in synthetic resin wear away the dies. Further, implements cannot be manufactured at a high speed because of a slow extruding speed. On the other hand, leakage-preventing implements can be manufactured at a high speed by the novel method. The unit structural portions 16 are embossed using the embossing rolls 18. Then the sheet is wound up by a take-up roll 19. Each unit structural portion 16 has a large length l but has a short width d in the direction of the winding. Therefore, the error caused by shrinkage is negligible whether when the take-up roll 19 applies a tension to the sheet or when the sheet is relieved from the tension to rewind the sheet after the unit structures are embossed. Consequently, the width and the length of each unit structural portion can be obtained with desired accuracy. Examples of the soft ferrite include Mn-Zn ferrite and Ni-Zn ferrite. Examples of the hard ferrite include Ba ferrite and Sr ferrite. Examples of the synthetic resin include polypropylene, polyamide, polyphenyl sulfide, polyvinyl chloride, and polymethylpentene. The polymethylpentene is used in the implements shown in FIGS. 1–3.

In the microwave leakage-preventing implement shown in FIGS. 6 and 7, the synthetic resin layer containing the soft ferrite forms the top surface. The synthetic resin layer containing the hard ferrite underlies the top layer. The hard ferrite is magnetized. The grooved portions used for separation are formed at regular intervals by press working or embossing. The unit structural portions are interconnected by the grooved portions. When the sheet is actually employed, plural unit structural portions can be used as a unit. Also, the unit structural portions 16 can be used individually by cutting the grooved portions. A separated unit structural portion can be mounted either on the inner surface of the door or on the fringe of the opening of the body. Alternatively, several interconnected unit structural portions 16 corresponding to the width of the peripheral frame 13 on the inner surface of the door are used as a unit.

With the implement constructed as described above, the magnetic force of the synthetic resin layer containing the hard ferrite attracts the door to the body. Therefore, if a gap is formed between the fringe of the opening of the body and the inner surface of the door, the gap can be occupied. If microwaves should leak through the gap, the waves would be attenuated by the synthetic resin layer containing the soft ferrite. In this way, leakage of the microwaves from the microwave oven can be prevented.

The fabrication method already described in connection with FIG. 7 can also be utilized to fabricate the microwave leakage-preventing implements show in FIGS. 1–3. At this time, the implements may each be a monolayer instead of a laminate. Also, it is possible to form a sheet provided with a number of vent holes, to form separation grooves in the sheet by press work or embossing, and to attach the sheet on the surface of the inner side wall of the body of a microwave oven.

What is claimed is:

1. An implement for preventing leakage of microwaves from a microwave oven, said implement comprising polymethylpentene in which carbon and a softener are dispersed, the polymethylpentene further containing either a ferrite or a powdered metal or both.

2. An implement for preventing leakage of microwaves from a microwave oven as set forth in claim 1, wherein said ferrite is a soft ferrite or a hard ferrite.

3. An implement for preventing leakage of microwaves from a microwave oven as set forth in claim 1 or 2, wherein said powdered metal is a powdered pure metal, an oxide of a powdered pure metal, or a combination thereof.

4. An implement for preventing leakage of microwaves from a microwave oven as set forth in any one of claim 1, wherein 20–85% by weight of the ferrite is added to 15–80% by weight of the polymethylpentene.

5. An implement for preventing leakage of microwaves from a microwave oven as set forth in claim 1, wherein 0.05–0.20 part of the softener is added to 1 part of the polymethylpentene.

6. An implement for preventing leakage of microwaves from a microwave oven as set forth in claim 1, wherein said implement is a plate having a multiplicity of vent holes for mounting on the inner surface of said oven.

7. A microwave oven consisting of a body having an opening and a door at said opening for closing said opening and having an implement for preventing leakage of microwaves from said oven, wherein said implement is mounted on at least one of the fringe of the opening and the inner surface of said door bearing against the fringe, said implement being an annular sheet substantially similar in shape to said fringe of said opening, said annular sheet consisting essentially of polymethylpentene and having an inner portion and an outer portion, a hard ferrite being dispersed in one of said inner and outer portions, a soft ferrite being dispersed in the other of said portions and said hard ferrite being magnetized.

8. A microwave oven consisting of a body having an opening and a door at said opening for closing said opening and having an implement for preventing leakage of microwaves from said oven, wherein said implement is mounted on at least one of the fringe of the opening and the inner surface of said door bearing against said fringe, said implement being an annular sheet substantially similar in shape to said fringe of said opening, and wherein a permanent magnet is buried in a portion of said annular sheet to attract said door to said fringe.

9. An implement for preventing leakage of electromagnetic waves, said implement comprising a laminated sheet consisting of a layer of a synthetic resin containing a soft ferrite and a layer of synthetic resin containing a hard ferrite, said hard ferrite being magnetized, said sheet having grooved portions for separation and a plurality of portions separated by said grooved portions.

10. An implement for preventing leakage of electromagnetic waves, as set for the in claim 9, wherein said grooved portions have a thickness of 0.3 to 0.5 mm.

* * * * *